US011002288B2

(12) United States Patent
Zhang et al.

(10) Patent No.: US 11,002,288 B2
(45) Date of Patent: May 11, 2021

(54) INTEGRATED STRUCTURE OF REFLUXER AND PRESSURE DIFFUSER, AND CENTRIFUGAL COMPRESSOR

(71) Applicant: Gree Electric Appliances, Inc. of Zhuhai, Zhuhai (CN)

(72) Inventors: Zhiping Zhang, Zhuhai (CN); Ruixing Zhong, Zhuhai (CN); Nan Jiang, Zhuhai (CN); Caiyun Jiang, Zhuhai (CN); Yuhui Chen, Zhuhai (CN); Zengyue Liu, Zhuhai (CN); Liandong Lei, Zhuhai (CN); Yi Zhou, Zhuhai (CN); Jianfei Liu, Zhuhai (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 65 days.

(21) Appl. No.: 16/466,159

(22) PCT Filed: Sep. 25, 2017

(86) PCT No.: PCT/CN2017/103127
§ 371 (c)(1),
(2) Date: Jun. 3, 2019

(87) PCT Pub. No.: WO2018/103415
PCT Pub. Date: Jun. 14, 2018

(65) Prior Publication Data

US 2020/0063754 A1 Feb. 27, 2020

(30) Foreign Application Priority Data

Dec. 5, 2016 (CN) ..... 201611102983.5

(51) Int. Cl.
*F04D 29/44* (2006.01)
*F04D 17/12* (2006.01)
(Continued)

(52) U.S. Cl.
CPC ..... *F04D 29/444* (2013.01); *F04D 17/122* (2013.01); *F04D 29/023* (2013.01);
(Continued)

(58) Field of Classification Search
CPC .... F04D 29/444; F04D 29/684; F04D 29/023; F04D 29/441; F04D 29/5846; F05D 2230/21
See application file for complete search history.

(56) References Cited

U.S. PATENT DOCUMENTS 5,344,285 A 9/1994 O'Sullivan et al.
8,602,730 B2 * 12/2013 Richter ..... F04D 17/122 415/211.2
(Continued)

FOREIGN PATENT DOCUMENTS

CN 102817857 A 12/2012
CN 103016409 A 4/2013
(Continued)

OTHER PUBLICATIONS

Extended European Search Report for EP Application No. 17877979.9 dated Oct. 29, 2019 (7 pages).
(Continued)

*Primary Examiner* — Brian P Wolcott
(74) *Attorney, Agent, or Firm* — Brandon V. Zuniga; James R. Gourley; Carstens & Cahoon, LLP

(57) ABSTRACT

An integrated structure of a return device and a pressure diffuser, and a centrifugal compressor are provided. The structure includes a pressure diffuser portion and a return device portion integrally molded with the pressure diffuser portion. The pressure diffuser portion is configured to form a pressure diffusion flow channel. The return device portion has a return channel. The return channel is in communication with the pressure diffusion flow channel, and is con-
(Continued)

figured to guide gas from the pressure diffusion flow channel. The structure of the present invention eliminates a need of independently installing a return device and a pressure diffuser, and eliminates connection seams caused by assembly and misalignment caused by accumulated errors. Therefore, gas can smoothly flow through the pressure diffusion flow channel into the return channel, such that a gas flow is well guided, and the gas flow uniformity is better.

14 Claims, 4 Drawing Sheets

(51) Int. Cl.
*F04D 29/02* (2006.01)
*F04D 29/68* (2006.01)
*F04D 29/58* (2006.01)

(52) U.S. Cl.
CPC ..... *F04D 29/441* (2013.01); *F04D 29/5846* (2013.01); *F04D 29/684* (2013.01)

(56) References Cited

U.S. PATENT DOCUMENTS

| | | | | |
|---|---|---|---|---|
| 10,400,788 | B2 * | 9/2019 | Nakaniwa | F04D 29/44 |
| 2018/0172025 | A1 * | 6/2018 | Koga | F04D 29/462 |
| 2020/0300251 | A1 * | 9/2020 | Yamashita | F04D 29/444 |

FOREIGN PATENT DOCUMENTS

| | | | | | |
|---|---|---|---|---|---|
| CN | 103062077 | A | | 4/2013 | |
| CN | 203009399 | U | | 6/2013 | |
| CN | 103062077 | B | | 5/2014 | |
| CN | 204175653 | U | | 2/2015 | |
| CN | 104454652 | A | | 3/2015 | |
| CN | 204828057 | U | | 12/2015 | |
| CN | 106151063 | A | | 11/2016 | |
| CN | 106762841 | A | | 5/2017 | |
| CN | 106870447 | A | * | 6/2017 | |
| CN | 206377069 | U | | 8/2017 | |
| EP | 0703368 | A2 | | 3/1996 | |
| EP | 0703368 | A3 | | 4/1998 | |
| FR | 1326166 | A | | 5/1963 | |
| JP | 2003083281 | A | | 3/2003 | |
| JP | 2010285899 | A | | 12/2010 | |
| JP | 2014088785 | A | | 5/2014 | |
| JP | 2014240612 | A | | 12/2014 | |
| JP | 2015165109 | A | | 9/2015 | |
| JP | 2016151266 | A | | 8/2016 | |
| WO | WO-2016047256 | A1 | * | 3/2016 | F04D 29/444 |

OTHER PUBLICATIONS

Examination Report for Indian Patent Application No. 201937021837 dated Sep. 22, 2020 (7 pages).

* cited by examiner

INTEGRATED STRUCTURE OF REFLUXER AND PRESSURE DIFFUSER, AND CENTRIFUGAL COMPRESSOR

CROSS-REFERENCE TO RELATED APPLICATIONS

This application is a US 371 Application from PCT/CN2017/103127 filed Sep. 25, 2017, which claims priority to Chinese Application No. 201611102983.5 filed Dec. 5, 2016, the technical disclosures of which are hereby incorporated herein by reference.

TECHNICAL FIELD

The invention relates to the technical field of a centrifugal compressor, and particularly, to an integrated structure of a return device and a pressure diffuser, and a centrifugal compressor.

BACKGROUND

A centrifugal compressor, also known as a radial flow compressor, is widely used in various processes, mainly for conveying air, various process gases or mixed gases, and increasing their pressure. The multi-stage centrifugal compressor generally includes a main shaft, a first-stage impeller, a first-stage pressure diffuser cover plate, a first-stage pressure diffuser, a return device, a second-stage impeller, a second-stage pressure diffuser cover plate, and a second-stage pressure diffuser. When the compressor is operating, the main shaft drives the first-stage impeller to rotate, and the gas from the gas intake chamber is thrown by the first-stage impeller into the first-stage pressure diffusion flow channel formed by the first-stage pressure diffuser cover plate and the first-stage pressure diffuser; after the gas passes through the first-stage pressure diffusion flow channel, it enters the gas intake flow passage upstream of the second-stage impeller; the second-stage impeller is also driven by the main shaft to rotate, and the gas from the gas intake flow channel is thrown by the second-stage impeller into the second-stage pressure diffusion flow channel formed by the second-stage pressure diffuser cover plate and the second-stage pressure diffuser; in this process, the gas is gradually compressed and thus has a high pressure. In a centrifugal compressor, the function of the return device is to guide a flow and the strong swirling gas flow flowing out of the first-stage pressure diffuser to uniformly enter the next stage impeller in a circumferential direction or in a specific direction.

In the prior art, the return device is usually a separate component, which is connected to the pressure diffuser by screws, pins or welding, so as to be fastened and positioned. This type of structure in the prior art has the following technical defects: (1) the assembly precision is low; the energy loss is large; when the return device, as a separate component, is connected with the diffuser, it needs to be aligned first and then it is connected by screws, pins or welding; in the process, there are not only connection seams generated, but also misalignment easily caused by accumulated errors; when the gas from the pressure diffuser flow channel impacts at the connection seams or the misalignment position, there will be a larger energy loss, such as the kinetic energy loss and the impact loss, etc.; (2) the assembly efficiency is low; since high precision installation is needed, the assembly rate is slow, and the efficiency is low; (3) after the return device is connected with the pressure diffuser, there is a gap between the end of the return device vane and the pressure diffuser, and the gas from the pressure diffusion flow channel is easily leaked from the gap, thus avoiding the flow guiding action of the return device, affecting the gas guided by the return device and impairing the gas flow uniformity; (4) if the return device and the pressure diffuser are connected by screws or pins, threaded holes are needed to be provided in the return device vane, then the screws or pins can go through the pressure diffuser to thread with the threaded holes, so as to realize a fixation; with such a connection manner, the return device vane has to have a certain thickness, which results in that a small number of vanes can be arranged in the return device, and results in that a difference between the vane angle and the gas flow angle of the gas impact is large, and a larger gas impact angle is generated, which is unfavorable for guiding flow and causes energy loss, such as the impact loss.

SUMMARY OF THE INVENTION

Therefore, the technical problem to be solved by the present invention is to overcome the technical defects that, the return device in the prior art, as a separate component, is connected with the pressure diffuser by screws, pins or welding, which will result in low assembly efficiency and a large energy loss. The objective of the present invention is to provide an integrated structure of a return device and a compressor diffuser, which has high assembly efficiency and low energy loss.

The present invention further provides a centrifugal compressor including an integrated structure of a return device and a compressor diffuser.

For this purpose, the present invention provides an integrated structure of a return device and a pressure diffuser, including a pressure diffuser portion and a return device portion integrally molded with the pressure diffuser portion; the pressure diffuser portion is configured to form a pressure diffusion flow channel; the return device portion has a return channel; the return channel is in communication with the pressure diffusion flow channel, and is configured to guide gas from the pressure diffusion flow channel.

In an embodiment, the pressure diffuser portion and the return device portion are integrally molded by casting.

In an embodiment, the return channel has an inlet and an outlet, and a width a of the inlet is less than or equal to a width b of the outlet.

In an embodiment, the width b of the outlet is configured to be not greater than four times the width a of the inlet.

In an embodiment, one side of the return channel is vertical, and another side of the return channel is gradually flared outward in a direction from the inlet to the outlet; an angle between said another side and a vertical direction is $\beta$, wherein, $0 \leq \beta \leq 45°$.

In an embodiment, an inner wall of the return channel is provided with return vanes; and the return vanes are distributed evenly in serial arrays or in a single array.

In an embodiment, an outer edge of the return vane is rigidly connected with an inner wall of the return channel; a vane mounting angle $\alpha$ is formed between a first tangent line of the return vane, which is located at a position where the return vane contacts with the inner wall of the return channel, and a second tangent line of the inner wall of the return channel, which is located at the position; and the vane mounting angle a is ranged from 10° to 80°.

In an embodiment, the integrated structure of the return device and the pressure diffuser further includes pressure diffusion vanes, which are arranged inside the pressure diffusion flow channel.

In an embodiment, a width of the pressure diffusion vane is not greater than a width of an impeller, and the impeller is arranged opposite to the pressure diffusion vane to feed gas into the pressure diffusion flow channel.

The present invention further provides a centrifugal compressor, including a main shaft, an impeller installed on the main shaft, and a pressure diffuser cover plate; the centrifugal compressor further includes any one of the integrated structure of the return device and the pressure diffuser above; and the pressure diffuser cover plate is opposite to the pressure diffuser portion to form the pressure diffusion flow channel.

In an embodiment, the centrifugal compressor has at least two stages; an accommodating space is disposed between the return device portion of a front stage and a second-stage impeller of a subsequent stage; the accommodating space is in communication with a gas supplying passage, and the gas supplying passage is configured to supply gas into the accommodating space.

In an embodiment, the gas supplying passage is in communication with an expansion valve, and configured to feed a part of refrigerant expanded by the expansion valve into the accommodating space to lower temperature and to supply gas.

The technical solutions provided by the present invention have the following advantages:

1. The integrated structure of the return device and the pressure diffuser of the present disclosure includes the pressure diffuser portion and the return device portion, and the pressure diffuser portion and the return device portion are integrated to be one component, which is no longer a prior art structure formed by secondarily connecting and integrating a separate pressure diffuser and a separate return device with screws, pins or welding. With such a configuration, the integrated structure of the present invention not only eliminates a need of independently installing a return device and a pressure diffuser, but also eliminates connection seams caused by assembly and misalignment caused by accumulated errors, etc. Therefore, the gas can smoothly flow from the pressure diffusion flow channel into the return channel, and the energy loss is small; by integrating the return device portion and the pressure diffuser portion, the return vane is separately arranged in the return channel and needs not to be connected to the pressure diffuser any longer, which eliminates the problem in the prior art that air leakage is caused due to a seam between the end of the return vane and the pressure diffuser, and eliminates the phenomenon that part of the gas is leaked from the seam, avoiding the guiding action of the return device and affecting the gas guided by the return device. Therefore, when the integrated structure of the present invention is applied in a centrifugal compressor, it can improve the flow guiding effect and the gas flow uniformity. Preferably, the pressure diffuser portion and the return device portion are integrally molded by casting.

2. In the integrated structure of the present invention, the gas flow flowing from the pressure diffusion flow channel into the return channel is an unstable flow with a larger velocity, and the flow loss is larger, therefore the configuration that the width of the inlet is less than or equal to the width of the outlet enables the return channel to perform a certain function of pressure diffusion, thereby reducing the flow velocity and improving the stability of the gas flow. Considering that the roughness of the inner surface of the return channel is relative large, the width of the outlet is further configured to be not greater than four times the width of the inlet, thereby ensuring the gas to flow through the return channel smoothly; one side of the return channel is vertical, and the other side is gradually flared outward in the direction from the inlet to the outlet. The angle between the other side and the vertical direction is ranged from 0 to 45°, which can guide the gas to flow to a preset side, thereby improving the flow guiding effect.

3. In the integrated structure of the present invention, the inner wall of the return channel is provided with return vanes, which are distributed evenly in serial arrays or in a single array, thereby uniformly guiding the gas from the pressure diffusion flow channel.

4. In the integrated structure of the present invention, the outer edge of the return vane is rigidly connected with the inner wall of the return channel. The vane mounting angle is formed between a first tangent line of the return vane, which is located at a position where the return vane contacts with the inner wall of the return channel, and a second tangent line at a corresponding position of the inner wall of the return channel. The vane mounting angle is ranged from 10° to 80°. Such a structure makes the vane mounting angle of the return vane relatively identical to an actual flow angle of the gas flow, thereby reducing the impact loss.

5. In the integrated structure of the present invention, for certain models with high requirements for gas flow uniformity, such as a heat pump or an ice-storage unit, in order to ensure high performances in the heating conditions or in the ice-storage conditions, pressure diffusion vanes are further arranged inside the pressure diffusion flow channel. The gas flow entering the pressure diffusion flow channel is preliminarily guided by the pressure diffusion vanes, and then is secondarily guided after flowing into the return channel, thereby further improving the gas flow uniformity.

6. In the integrated structure of the present invention, the width of the pressure diffusion vane is not greater than the width of the impeller, which is arranged opposite to the pressure diffusion vane to feed the gas into the pressure diffusion flow channel, thereby preventing gas reflux, and ensuring the convergence of the flow.

7. The present invention also provides a centrifugal compressor, including a main shaft, an impeller, a pressure diffuser cover plate, and any one of the integrated structures described above. The centrifugal compressor of the disclosure employs the integrated structure above, therefore it has all of the advantages brought by the integrated structure above.

8. The centrifugal compressor of the present invention has at least two stages, and an accommodating space is disposed between the return device portion of the front stage and the second-stage impeller of the subsequent stage; the accommodating space is in communication with the gas supplying passage, and the gas supplying passage is configured to supply gas into the accommodating space, thereby improving the compression efficiency; when the centrifugal compressor is applied in a refrigerating apparatus, after the gas is compressed, the gas pressure is increased, and the gas temperature is relatively high; at this time, the gas supplying passage is in communication with an expansion valve, which enables a part of the refrigerant expanded by the expansion valve to flow into the accommodating space, thereby performing the functions of not only supplying gas, but also lowering the temperature.

BRIEF DESCRIPTION OF THE DRAWINGS

In order to describe the solutions of the prior art or the solutions of embodiments of the present invention more clearly, the present disclosure will be described briefly with reference to the figures used in describing the embodiments or the prior art. It is obvious that, for those skilled in the art, other figures can be obtained according to the figures provided hereafter without any creative work.

Figure 1:
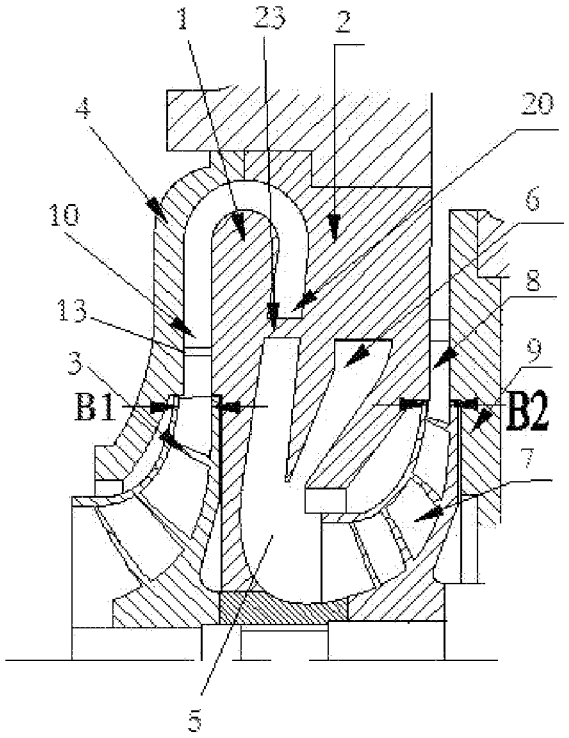
FIG. 1 is a schematic structural view of an integrated structure of a return device and a pressure diffuser according to the present invention.

The above figures include the following reference numerals:

1—pressure diffuser portion, 10—pressure diffusion flow channel, 13—pressure diffusion vane, 2—return device portion, 20—return channel, 21—inlet, 22—outlet, 23—return vane, 4—pressure diffuser cover plate, 5—accommodating space, 6—gas supplying passage, 7—second-stage impeller, 8—second-stage pressure diffusion flow channel, 9—second-stage pressure diffuser cover plate.

DETAILED DESCRIPTION OF THE PREFERRED EMBODIMENTS

The technical solutions of the present invention will be described with reference to the accompanying figures. Obviously, what described below are several but not all embodiments of the present invention. For those skilled in the art, other embodiments obtained based on the embodiments of the present invention without creative work are within the scope of the present invention.

It should be specified that, the terms "first" and "second" in the description are just used to describe the object, but should not be understood to indicate or imply the relative importance. What's more, the technical features described below in different embodiments of the present invention may be combined with each other, so long as there are no conflicts.

The First Embodiment

This embodiment provides an integrated structure of a return device and a pressure diffuser. As shown in FIG. 1, the integrated structure includes a pressure diffuser portion 1 and a return device portion 2 integrally molded with the pressure diffuser portion 1. The pressure diffuser portion 1 is configured to form a pressure diffusion flow channel 10. The return device portion 2 has a return channel 20. The return channel 20 is in communication with the pressure diffusion flow channel 10, and is configured to guide the gas from the pressure diffusion flow channel 10.

In the integrated structure of the return device and the pressure diffuser of the embodiment, the pressure diffuser portion 1 and the return device portion 2 are integrated to be one component, which is no longer a prior art structure formed by secondarily connecting and integrating a separate pressure diffuser and a separate return device with screws, pins or welding. With such a configuration, the integrated structure of the present invention not only eliminates a need of independently installing a return device and a pressure diffuser, but also eliminates connection seams caused by assembly and misalignment caused by accumulated errors, etc. Therefore, the gas can smoothly flow from the pressure diffusion flow channel 10 into the return channel 20, and the energy loss is small; in the integrated structure of the return device portion 2 and the pressure diffuser portion 1, the return vane 23 is separately arranged in the return channel 20 and is not connected to the pressure diffuser any longer, which eliminates the problem in the prior art that air leakage is caused due to a seam between the end of the return vane 23 and the pressure diffuser, and eliminates the phenomenon that part of the gas is leaked from the seam, avoiding the guiding action of the return device and affecting the gas guided by the return device. Therefore, when the integrated structure of the present invention is applied in a centrifugal compressor, it can improve the flow guiding effect and the gas flow uniformity. In this embodiment, the pressure diffuser portion 1 and the return device portion 2 are integrally molded by casting.

Figure 2:
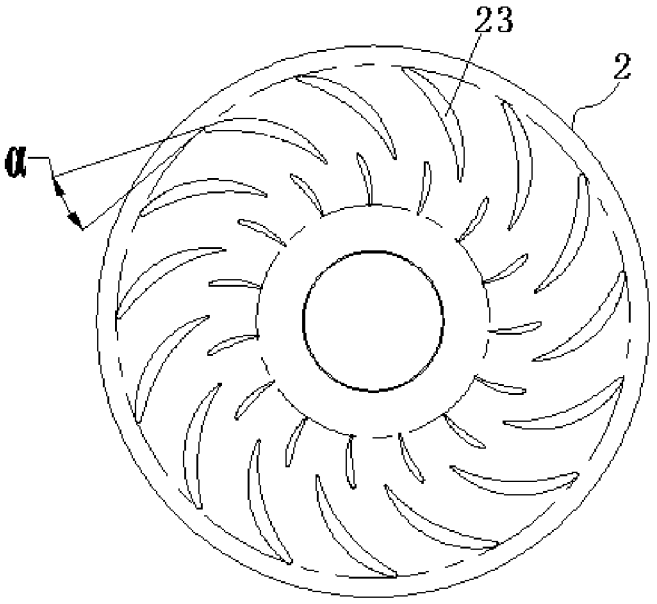
FIG. 2 is a schematic structural view illustrating the return vanes distributed in serial arrays in the return channel.
Figure 3:
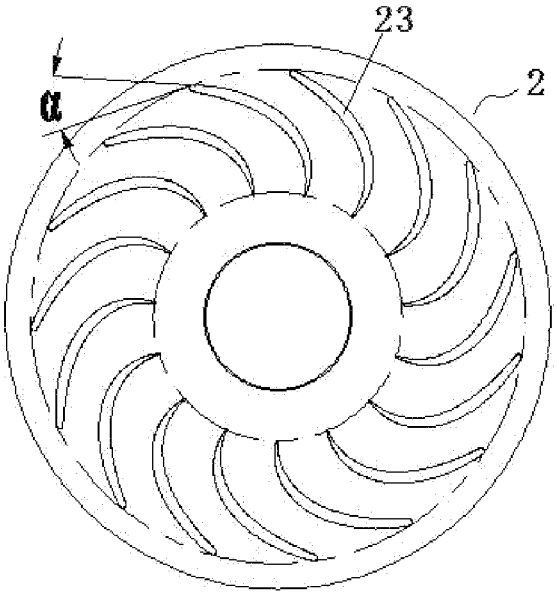
FIG. 3 is a schematic structural view illustrating the return vanes distributed in a single array in the return channel.
Figure 4:
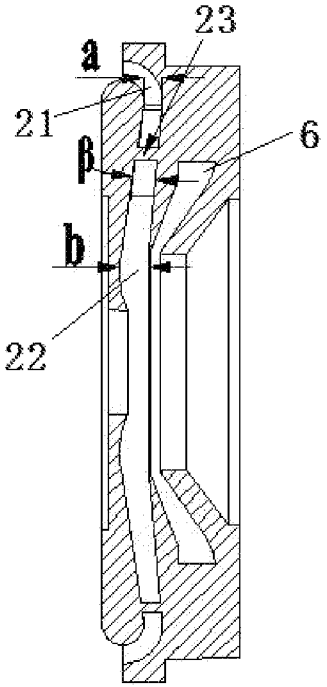
FIG. 4 is a cross-sectional view of the integrated structure installed on a main shaft according to the present invention.

As shown in FIGS. 2-4, the return channel 20 has an inlet 21 and an outlet 22, and the width a of the inlet 21 is less than or equal to the width b of the outlet 22. The gas flow flowing from the pressure diffusion flow channel 10 into the return channel 20 is an unstable flow with a larger velocity, and the flow loss is larger, therefore the configuration that the width a of the inlet 21 is less than or equal to the width b of the outlet 22 enables the return channel 20 to perform a certain function of pressure diffusion, thereby reducing the flow velocity and improving the stability of the gas flow. Considering that the roughness of the inner surface of the return channel 20 is relative large, the width b of the outlet 22 is further configured to be not greater than four times the width a of the inlet 21, thereby ensuring the gas to flow through the return channel smoothly; in this embodiment, the width a of the inlet 21 is four-fifths of the width b of the outlet.

One side of the return channel 20 is vertical, and the other side is gradually flared outward in the direction from the inlet 21 to the outlet 22. The angle between the other side and the vertical direction is $\beta$, and $0 \leq \beta \leq 45°$. Such a structure can guide the gas to flow to a preset side, thereby improving the flow guiding effect.

As shown in FIG. 2, the inner wall of the return channel 20 is provided with return vanes 23, which are distributed evenly in serial arrays. The thickness of the return vane 23 is ranged from 5 mm to 40 mm, and the number of the return vanes is ranged from 3 to 50. For an ordinary model with lower requirements for the gas flow uniformity, as shown in FIG. 3, the return vanes may also be distributed evenly in a single array.

The outer edge of the return vane 23 is rigidly connected with the inner wall of the return channel 20. A vane mounting angle $\alpha$ is formed between a first tangent line of the return vane 23, which is located at a position where the return vane 23 contacts with the inner wall of the return channel 20, and a second tangent line at a corresponding position of the inner wall of the return channel 20. The vane mounting angle $\alpha$ is ranged from 10° to 80°. Such a structure makes the vane mounting angle $\alpha$ of the return vane 23 relatively identical to an actual flow angle of the gas flow, thereby reducing the impact loss.

Figure 5:
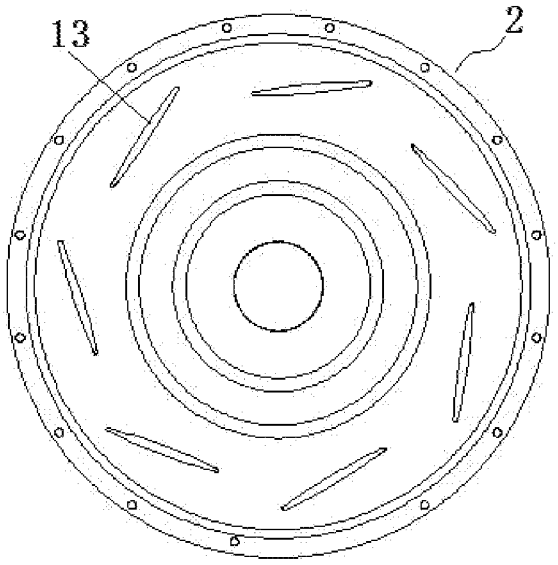
FIG. 5 is a schematic structural view illustrating the first-stage pressure diffusion vane distributed in the pressure diffusion flow channel.
Figure 6:
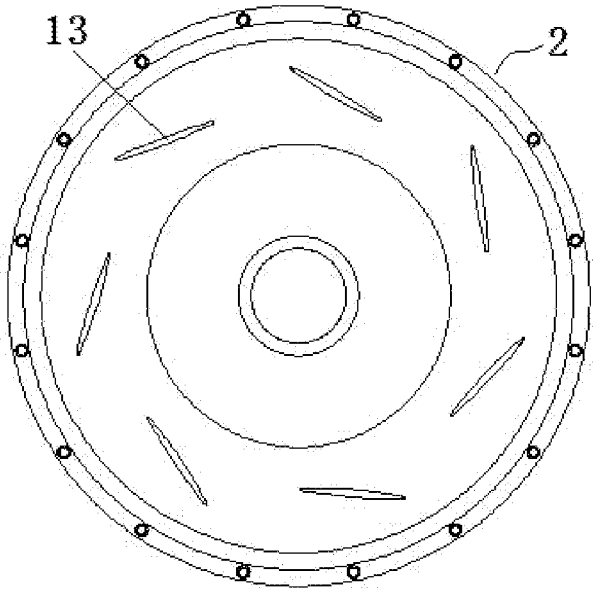
FIG. 6 is a schematic structural view illustrating the second-stage pressure diffusion vane distributed in the pressure diffusion flow channel.
Figure 7:
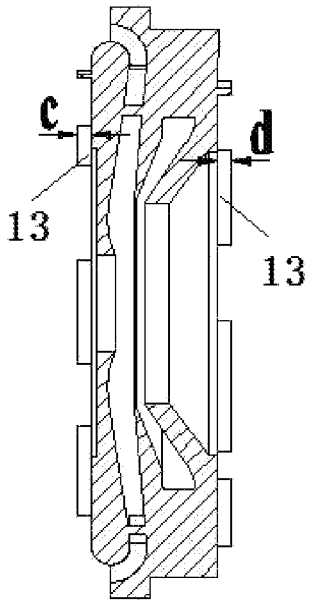
FIG. 7 is a cross-sectional view of the integrated structure provided with the first-stage pressure diffusion vane and the second-stage pressure diffusion vane and installed on the main shaft.

As shown in FIGS. 5-7, pressure diffusion vanes 13 are further arranged inside the pressure diffusion flow channel 10, and the pressure diffusion vanes 13 may also be disposed on the return device portion 2. The gas flow entering the pressure diffusion flow channel 10 is preliminarily guided by the pressure diffusion vane 13, and then is secondarily guided after flowing into the return channel 20, thereby further improving the gas flow uniformity. In addition, the pressure diffusion vane 13 may be arranged on the pressure diffuser cover plate 4 which, together with the pressure diffuser portion 1, forms the pressure diffusion flow channel.

The width of the pressure diffusion vane 13 is not greater than the width of the impeller 3, which is arranged opposite to the pressure diffusion vane to feed the gas into the pressure diffusion flow channel 10. As shown in FIG. 7, c is the thickness of the primary pressure diffusion vane 13, and d is the thickness of the secondary pressure diffusion vane 13; the thickness of the primary pressure diffusion vane 13 is less than the width B1 of the impeller 3 shown in FIG. 1, and the thickness of the secondary pressure diffusion vane 13 is less than the width B2 of the second-stage impeller 7 shown in FIG. 1, thereby preventing gas reflux, and ensuring the convergence of the flow.

The integrated structure of this embodiment can be applied not only in a two-stage centrifugal compressor, but also in a three-stage or multiple-stage centrifugal compressor.

The Second Embodiment

This embodiment provides a centrifugal compressor, including a main shaft, an impeller 3 installed on the main shaft, and a pressure diffuser cover plate 4, and further including the integrated structure described in the first embodiment; the pressure diffuser cover plate 4 is opposite to the pressure diffuser portion 1 to form the pressure diffusion flow channel 10.

The centrifugal compressor of this embodiment employs the integrated structure above, therefore it has all of the advantages brought by the integrated structure above.

The centrifugal compressor has two stages, and an accommodating space 5 is disposed between the return device portion 2 of the front stage and the second-stage impeller 7 of the subsequent stage. The accommodating space 5 is in communication with the gas supplying passage 6, and the gas supplying passage 6 is configured to supply gas into the accommodating space 5, thereby improving the compression efficiency.

The operating process of the two-stage centrifugal compressor is as follows: the main shaft drives the impeller 3 to rotate, throwing the gas into the pressure diffusion flow channel 10, which is formed by the pressure diffuser cover plate 4 and the pressure diffuser portion 1; the gas from the pressure diffusion flow channel 10 flows through the return channel 20, and then enters the accommodating space 5; the second-stage impeller 7 is driven by the main shaft to rotate as well, throwing the gas in the accommodating space 5 into the second-stage pressure diffusion flow channel 8, which is formed by the second-stage pressure diffuser cover plate 9 and the integrated structure, thereby further increasing the gas pressure.

In an embodiment, when the centrifugal compressor of this embodiment is applied in a refrigerating apparatus, the gas supplying passage 6 is in communication with an expansion valve and configured to feed a part of the refrigerant expanded by the expansion valve into the accommodating space 5 to lower the temperature and supply gas, thereby performing the functions of not only supplying gas, but also lowering the temperature.

It is obvious that, what described above are preferred embodiments to provide illustration for the examples clearly, but not intended to limit the present invention. For those skilled in the art, various changes or modifications can be made based on the description above. There is no need for the disclosure to exhaustively describe all possible embodiments. Any obvious changes or modifications derived from the present disclosure are all within the scope of the present invention.

What is claimed is:

1. An integrated structure of a return device and a pressure diffuser, comprising a pressure diffuser portion and a return device portion integrally molded with the pressure diffuser portion; wherein;

the pressure diffuser portion is configured to form a pressure diffusion flow channel;

the return device portion has a return channel;

the return channel is in communication with the pressure diffusion flow channel, and is configured to guide gas from the pressure diffusion flow channel;

the return channel has an inlet and an outlet, and a width a of the inlet is less than or equal to a width b of the outlet; and the width b of the outlet is configured to be not greater than four times the width a of the inlet.

2. The integrated structure of the return device and the pressure diffuser according to claim 1, wherein the pressure diffuser portion and the return device portion are integrally molded by casting.

3. The integrated structure of the return device and the pressure diffuser according to claim 1, wherein;

one side of the return channel is vertical, and another side of the return channel is gradually flared outward in a direction from the inlet to the outlet;

an angle between said another side and a vertical direction is $\beta$, wherein $0 \leq \beta \leq 45°$.

4. The integrated structure of the return device and the pressure diffuser according to claim 1, wherein;

an inner wall of the return channel is provided with return vanes; and the return vanes are distributed evenly in serial arrays or in a single array.

5. The integrated structure of the return device and the pressure diffuser according to claim 4, wherein for each return vane;

an outer edge of the return vane is rigidly connected with an inner wall of the return channel;

a vane mounting angle $\alpha$ is formed between a first tangent line of the return vane, the first tangent line of the return vane being located at a position where the return vane contacts the inner wall of the return channel, and a second tangent line of the return vane also located at the position where the return vane contacts the inner wall of the return channel; and the vane mounting angle $\alpha$ ranges from 10° to 80°.

6. The integrated structure of the return device and the pressure diffuser according to claim 1, further comprising pressure diffusion vanes arranged inside the pressure diffusion flow channel.

7. The integrated structure of the return device and the pressure diffuser according to claim 6, wherein; for each pressure diffusion vane: a width of the pressure diffusion vane is not greater than a width of an impeller, and the impeller is arranged opposite to the pressure diffusion vane to feed gas into the pressure diffusion flow channel.

8. A centrifugal compressor, comprising a main shaft, an impeller installed on the main shaft, and a pressure diffuser cover plate, wherein:

the centrifugal compressor further comprises the integrated structure of the return device and the pressure diffuser defined in claim 1; and the pressure diffuser cover plate is opposite to the pressure diffuser portion to form the pressure diffusion flow channel.

9. The centrifugal compressor according to claim 8, wherein;

the centrifugal compressor has at least two stages;

an accommodating space is disposed between the return device portion of a front stage and a second-stage impeller of a subsequent stage; and the accommodating space is in communication with a gas supplying passage, and the gas supplying passage is configured to supply gas into the accommodating space.

10. The centrifugal compressor according to claim 9, wherein the gas supplying passage is in communication with an expansion valve, and is configured to feed a part of refrigerant expanded by the expansion valve into the accommodating space to lower temperature and to supply gas.

11. The centrifugal compressor according to claim 8, wherein the pressure diffuser portion and the return device portion are integrally molded by casting.

12. The centrifugal compressor according to claim 8, wherein an inner wall of the return channel is provided with return vanes; and the return vanes are distributed evenly in serial arrays or in a single array.

13. The centrifugal compressor according to claim 12, wherein for each return vane;

an outer edge of the return vane is rigidly connected with an inner wall of the return channel;

a vane mounting angle $\alpha$ is formed between a first tangent line of the return vane, the first tangent line of the return vane being located at a position where the return vane contacts with-the inner wall of the return channel, and a second tangent line of the return vane also located at the position where the return vane contacts the inner wall of the return channel; and the vane mounting angle $\alpha$ ranges from 10° to 80°.

14. The centrifugal compressor according to claim 8, further comprising pressure diffusion vanes arranged inside the pressure diffusion flow channel.

* * * * *